US006322052B1

(12) United States Patent
Jeuthner et al.

(10) Patent No.: US 6,322,052 B1
(45) Date of Patent: Nov. 27, 2001

(54) VENTILATION VALVE

(75) Inventors: Hermann Jeuthner, Breitengüssbach; Alfons Leicht, Eggelsheim; Johann Georg Welz, Memmelsdorf, all of (DE)

(73) Assignee: Trench Germany GmbH, Bamberg (DE)

( * ) Notice: Subject to any disclaimer, the term of this patent is extended or adjusted under 35 U.S.C. 154(b) by 0 days.

(21) Appl. No.: 09/485,064

(22) PCT Filed: Jul. 29, 1998

(86) PCT No.: PCT/DE98/02210

§ 371 Date: Feb. 3, 2000

§ 102(e) Date: Feb. 3, 2000

(87) PCT Pub. No.: WO99/08291

PCT Pub. Date: Feb. 18, 1999

(30) Foreign Application Priority Data

Aug. 8, 1997 (DE) ..... 297 14 181 U

(51) Int. Cl.[7] ..... H01B 19/00

(52) U.S. Cl. ..... 251/321; 137/625.37

(58) Field of Search ..... 251/321, 322, 251/323, 291, 339, 318, 319, 320, 324, 325; 137/599.01, 625.28, 625.33, 625.37, 625.38

(56) References Cited

U.S. PATENT DOCUMENTS

| | | | | |
|---|---|---|---|---|
| 1,370,483 | * | 3/1921 | Powell | 251/321 X |
| 2,360,603 | * | 10/1944 | Ward | 251/323 X |
| 3,200,839 | * | 8/1965 | Gallagher | 251/323 X |
| 3,448,765 | * | 6/1969 | McKinney | 251/321 X |
| 3,807,689 | * | 4/1974 | Booth | 251/325 X |
| 4,372,907 | | 2/1983 | Herold et al. . | |
| 4,690,630 | | 9/1987 | Patrick et al. . | |
| 4,770,225 | * | 9/1988 | Takagi et al. | 164/305 |
| 5,648,132 | | 7/1997 | Shigehiko et al. . | |

* cited by examiner

*Primary Examiner*—Kevin Shaver
*Assistant Examiner*—Eric Keasel
(74) *Attorney, Agent, or Firm*—Barnes & Thornburg

(57) ABSTRACT

The aim of the invention is to provide an improved ventilation valve (8), especially for ventilating a mold (5) in the production of umbrella type insulators (1), so that harmful deformation of the molded body can be avoided during removal from the mold (5). This is achieved by providing the ventilation valve with a rod-like or pin-shaped housing (8.2) with an orifice (8.5) on one of its front faces and by providing a valve body (8.3) on the other front face which is detachably mounted in an axial extension of the valve housing (8.2).

12 Claims, 1 Drawing Sheet

VENTILATION VALVE

The present invention relates to a ventilation valve, particularly for ventilating a mold for producing umbrella-type insulators.

In the production of umbrella-type insulators, which consist of a core constructed as a solid or hollow body and several umbrellas which are molded to it and have downward extending collars provided thereon and connected with the core, the essentially funnel-shaped mold is filled with an elastomer, preferably made of silicone. The solidified body is then removed from the mold (German Patent Document DE-A-2618653). In the process, a vacuum is initially formed between the mold and the umbrella which first deforms the umbrella until air can flow into the mold at one point. During the removal from the mold, tensions and even cracks occur in the umbrella which make the umbrella unsuitable for a use as an insulator.

It is an object of the present invention to avoid the damaging deformation of molded bodies of any type during the removal from the mold by using a new type of ventilation valve.

This object is achieved by providing a ventilation valve with rod-type or pin-shaped valve housing on whose front face a valve orifice is provided and on whose back face a valve body is detachably and exchangeably mounted in an axial extension of the valve housing. The valve body has a bore which extends coaxially to an axially extending cylindrical valve space provided in the valve housing. A connecting rod is guided in the bore of the valve body which extends through the valve space to the valve orifice. A valve piston is provided at the end of the connecting rod which has a seal by which the valve orifice can be tightly closed. A pressure spring clamped in between a pressure surface of the valve body and the back side of the valve piston or a stop flange is arranged on the connecting rod and situated in the area of the valve space. The valve housing has an air inlet opening which extends into the valve space.

The ventilation valve according to the invention can be cleaned in a fast and simple manner because the valve body can easily be demounted from the valve housing and can therefore be cleaned outside a mold or the like. The ventilation valve according to the invention can also be used for other ventilation measures, particularly for other removal processes from a mold, in the case of which a vacuum will or may form.

Additional advantageous details of the invention are indicated in the subclaims and will be explained in detail in the following by means of an embodiment illustrated in the drawing.

Figure 1:
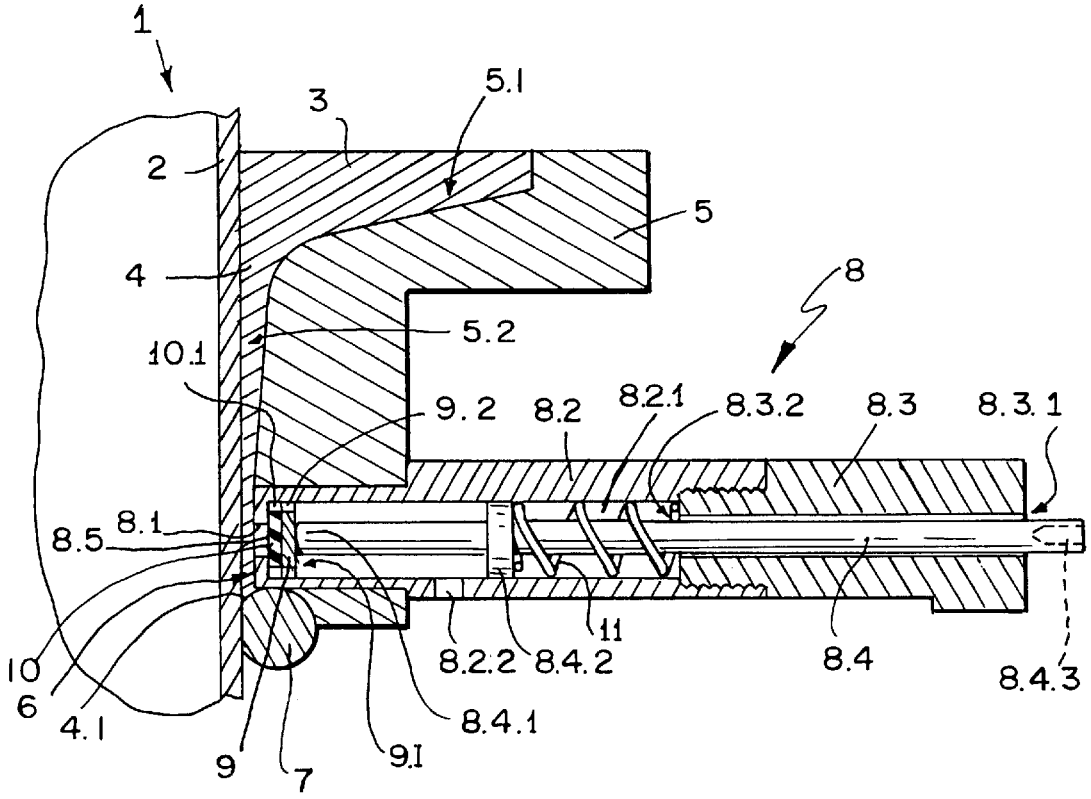
FIG. 1 is one half of a lateral view in the cross-section of an umbrella molded to a hollow core, together with the mold and the ventilation valve according to the invention in the cast condition of the umbrella.
Figure 3:
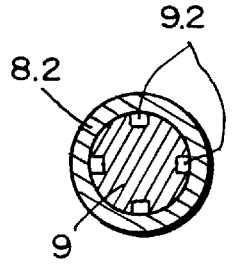
FIG. 3 is a view of the valve seat according to the intersection I—I of FIG. 2.
Figure 2:
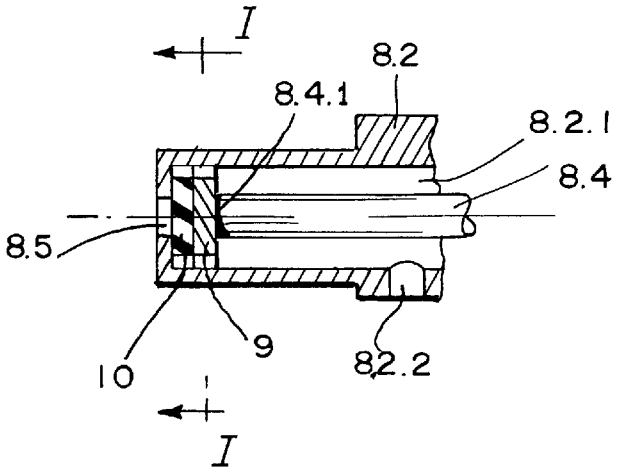
FIG. 2 is a view of a section of the ventilation valve with the valve seat.

Reference number 1 indicates a part of an umbrella-type insulator which has a core 2 or a core wall constructed as a hollow body and an umbrella 3 molded thereto which has a molded-on collar 4. The core 2 consists of an insulating material, preferably silicone, which is reinforced by means of reinforcing materials, particularly glass fibers. A one-piece or multi-piece mold 5 is pushed over the core 2, which mold 5 has a funnel-shaped mold space 5.1 shaped corresponding to the umbrella 3 with the collar 4 to be molded.

The portion 5.2 of the mold space 5.1 forming the collar 4 has a ring gap 6 at the collar end 4.1, which ring gap 6 is closed off for the casting process by an elastic seal 7, such as a ring seal or O-seal.

In the area of the collar end 4.1, a rod-like or pin-shaped ventilation valve 8 is provided laterally in the mold 5, for example, in the form of a disk valve or cone valve. The ventilation valve 8 can be screwed into the mold 5 or may, for example, by tightly inserted and fastened by means of a stud screw or the like. The outer surface 8.1 of the ventilation valve 8 advantageously extends to the surface of the umbrella 3 or to the surface 4.2 of the collar 4 of the umbrella 3. In particular, it is flush with the surface of the mold 5.

For producing an umbrella 3 with a collar 4, the mold 5 is first placed at the assigned location on the core 2 or on the core wall and is sealed off by means of the elastic seal 7. Subsequently, the mold space 5.1 is filled from above with a casting material which will then solidify to form an insulating body. A suitable material is an unreinforced or reinforced polymeric material, such as silicone, which is at first pourable and then solidifies as the result of cross-linkage. During the cross-linkage, this material bonds with the material of the core 2 or of the core wall. After the hardening or solidifying of the cast-in material, the mold 5, together with the seal 7, is moved downward in the drawing. In the resulting hollow space, a vacuum is now formed which, in the absence of the valve 8, pulls the umbrella 3 downward, particularly at the outer edge, whereby tensions or even cracks may be formed on its top side.

According to the invention, the ventilation valve 8 is constructed as a valve which, in the inoperative position, is in the closed position. It consists of a rod-type or pin-shaped valve housing 8.2 and of a valve body 8.3 which is screwed onto this valve housing 8.2 in an axial extension or can be screwed into this valve housing 8.2. In a preferably central bore 8.3.1, which is coaxial to the valve space 8.2.1 of the valve housing 8.1, a connecting rod 8.4 is guided in a displaceable manner.

The connecting rod 8.4 extends through the valve space 8.2.1. At the end 8.4.1 of the connecting rod 8.4, a valve piston 9 is provided which has a seal 10. In the inoperative position of the ventilation valve 8,, the seal rests sealingly against an orifice 8.5 of the outer surface 8.1 of the valve housing 8.2, in that it is held in the closed position by way of a pressure spring 11. For this purpose, the pressure spring 11 is clamped between a pressure surface 8.3.2 of the valve body 8.3 and a stop flange 8.4.2 provided in the area of the valve space 8.2.1 on the connecting rod 8.4, or is clamped on the rear side 9.1 of the valve piston 9.

By pulling on the end 8.4.3 protruding from the valve body 8.3, the connecting rod 8.4 can be pulled to the outside against the force of the pressure spring 11; the seal 10 can be lifted off the valve orifice 8.5; and the ventilation valve 8 can thus be opened.

The valve housing 8.2 has an air inlet opening 8.2.2, by way of which, when the ventilation valve 8 is open, air or another gaseous medium can flow into the valve space 8.2.1 and can flow out by way of the valve orifice 8.5. For a better air flow-through, the valve piston 9 is preferably provided with lateral overflow ducts 9.2 and optionally also the seal 10 is provided with correspondingly arranged lateral overflow ducts 10.1.

In the case of the illustrated system, the method of operation of the ventilation valve 8 according to the invention is as follows:

The initially described casting material is poured into the mold 5. After the solidification of the casting material, the mold 5, together with the elastic seal 7, is pushed downward in the drawing. Simultaneously—or preferably, shortly before—, the ventilation valve 8 is opened up and the mold 5 is ventilated thereby, so that the cast umbrella 3 can easily and without any damage be removed from the mold 5.

An important advantage of the new ventilation valve 8 consists of the fact that the valve housing 8.2 can be placed in the mold 5 and can be fastened in the mold 5, for example, by way of a stud screw, while, on the other hand, the valve body 8.3 with the connecting rod 8.4, the pressure spring 11, the valve piston 9 and the seal 10 can easily be detached from and taken out of the valve housing 8.2. These removed parts can then be cleaned outside the mold 5, if, for example, the overflow ducts 9.2 and/or 10.1 are clogged with the cast resin, particularly silicone. Individual parts may also easily be replaced. The valve housing 8.2 therefore remains fixedly connected with the mold 5. The cleaning and a possibly required replacement of parts can therefore take place more rapidly and more conveniently than in the case of a ventilation valve which forms a unit which cannot be separated.

What is claimed is:

1. A valve to ventilate a mold for producing umbrella-shaped insulators, comprising:

a pin-shaped valve housing;

a valve orifice on a front face of the valve housing;

a valve body detachably mounted on a back face as an axial extension of the valve housing, the valve body having a bore extending coaxially to an axially extending cylindrical valve space in the valve housing;

a connecting rod extending through the bore and through the valve space to the valve orifice;

a valve piston positioned at one end of the connecting rod and having a seal positioned on the front face of the valve piston to engage and tightly close the valve orifice;

at least one axial overflow duct in the piston;

the valve piston having a diameter corresponding to the inside diameter of the valve housing adjacent the valve orifice;

a pressure spring between a pressure surface of the valve body and a back side of the valve piston, and the valve housing having an air inlet opening which extends into the valve space.

2. The ventilation valve according to claim 1, further comprising a stop flange on the connecting rod and positioned at least partially within the valve space; wherein, the compression spring biases the piston toward the orifice by engaging the stop flange.

3. The ventilation valve according to claim 1, wherein the pressure spring biases the piston toward the orifice by engaging the back side of the valve piston.

4. The ventilation valve according to claim 1, wherein the seal is a flat, disk-shaped seal.

5. The ventilation valve according to one of claim 1, wherein the seal is provided with at least one axial overflow duct.

6. The ventilation valve according to claim 1, wherein the inside diameter of the housing extending from the valve orifice is constant over a path of travel of the valve piston.

7. The ventilation valve according to claim 1 wherein another end of the connecting rod projects beyond the valve body.

8. The ventilation valve according to claim 7 wherein the seal is provided with at least one axial overflow duct.

9. The ventilation valve according to claim 1, wherein the valve body is screwed into the valve housing.

10. The ventilation valve according to claim 9 wherein the seal is provided with at least one axial overflow duct.

11. The ventilation valve according to claim 9 wherein another end of the connecting rod projects beyond the valve body.

12. The ventilation valve according to claim 11 wherein the seal is provided with at least one axial overflow duct.

* * * * *